United States Patent [19]

Lacher

[11] 4,118,248

[45] Oct. 3, 1978

[54] AUTOMATIC DISCHARGE CENTRIFUGE AND METHOD

[76] Inventor: Jorge Halder Lacher, Apartado 285, Alajuela, Costa Rica

[21] Appl. No.: 778,353

[22] Filed: Mar. 17, 1977

[51] Int. Cl.[2] ..... C13F 1/10; B04B 3/00

[52] U.S. Cl. ..... 127/19; 127/17; 127/56; 210/78; 210/369; 210/370; 233/46

[58] Field of Search ..... 127/17, 18, 19, 56; 233/46; 210/78, 369, 370

[56] References Cited

U.S. PATENT DOCUMENTS

| | | | |
|---|---|---|---|
| 2,096,594 | 10/1937 | Sanchez y Cil | 127/19 UX |
| 3,226,257 | 12/1965 | Steele | 127/19 |
| 3,490,947 | 1/1970 | Grieselhuber | 127/19 |
| 3,836,070 | 9/1974 | Trawinski | 233/7 |

FOREIGN PATENT DOCUMENTS

| | | | |
|---|---|---|---|
| 1,077,150 | 3/1960 | Fed. Rep. of Germany | 233/46 |

OTHER PUBLICATIONS

George P. Meade, "Cane Sugar Handbook", 9th Edition, 246–252, John Wiley & Sons, Inc., New York, 1963.

"Principle of Sugar Tech.", vol. III, 241, Pieter Honig, Ed., Elsevier, New York, 1963.

*Primary Examiner*—Sidney Marantz

[57] ABSTRACT

A method for releasing compacted sugar crystals from a screen after centrifugation uses braking force for stopping rotation of the centrifuge. The brake stops rotation of the screen without simultaneously stopping rotation of the crystals accumulated adjacent the screen. The centrifuge may include one or more apertures in the base of the drum for exit of the sugar crystals.

7 Claims, 2 Drawing Figures

AUTOMATIC DISCHARGE CENTRIFUGE AND METHOD

BACKGROUND OF THE INVENTION

This invention relates to centrifuges.

Centrifuges used in the refinement of sugar are required to separate the particulate sugar crystals from the syrup fraction of the massecuite, magma, or mother liquor. In general, the centrifuge causes a mixture to be separated to pass through a perforated surface, such as a screen annularly mounted within a centrifugal drum. The screen has apertures sufficiently small to retain sugar crystals included in the mixture, but the syrup passes through the perforations for exit through an exit port. The sugar crystals accumulate at the screen and are compacted by centrifugal force. After the mixture has been separated, the sugar crystals remain against the screen and must be removed by some means. It has heretofore been common to scrape the inside wall of the screen to remove or "discharge" the sugar crystals.

Certain disadvantages attend this form of discharging the crystals. First, time is required to remove the sugar crystals from the centrifuge before the next charge may be admitted. Also, the crystals are occasionally damaged due to the scraping action. Finally, the discharing apparatus gradually wears out the screen within the centrifuge chamber.

Accordingly, an object of the present invention is to provide a centrifuge which requires no extra discharge equipment within the centrifuge.

A second object is to provide a centrifuge which is automatic in its discharge operation.

SUMMARY OF THE INVENTION

These and other objects are obtained by providing a brake associated with a centrifuge drum to decelerate the spinning centrifuge drum to a sudden stop. This rapid deceleration of the centrifuge drum and screen causes compacted sugar crystals to break loose of the screen. The crystaline mass continues in its rotation due to the rotational inertia imparted during centrifugation, but eventually the mass falls or slides down the screen through the force of gravity and exits the centrifuge through an exit apertures at the bottom of the centrifuge drum.

BRIEF DESCRIPTION OF THE DRAWINGS

In the description of the preferred embodiment reference is made to the appended drawings in which.

DESCRIPTION OF THE PREFERRED EMBODIMENT

Figure 1:
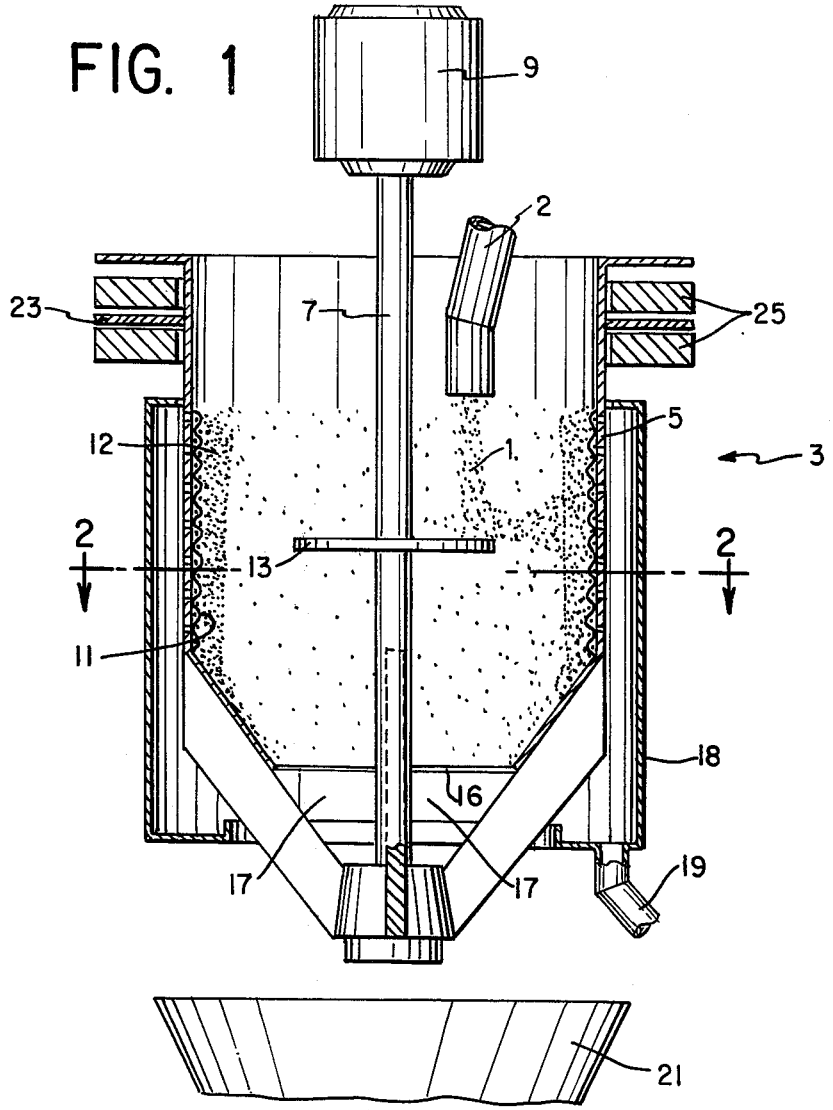
FIG. 1 is a diagramatic side view of a centrifuge according to the present invention.
Figure 2:
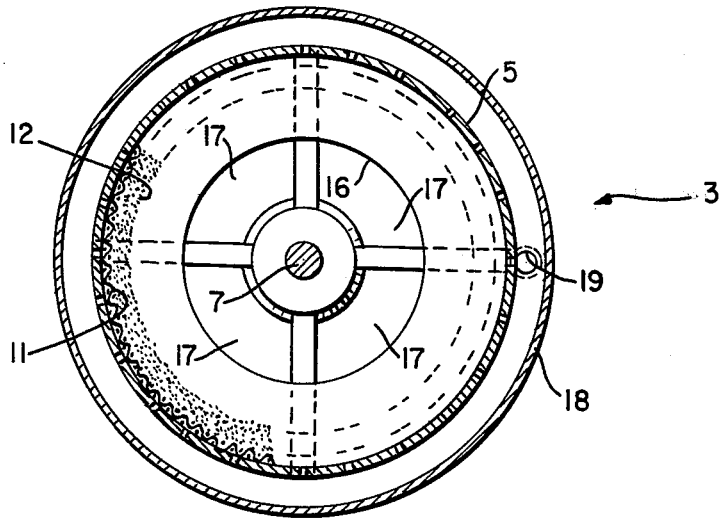
FIG. 2 is a sectional view along the line 2—2 of FIG. 1.

A centrifuge 3 includes a cylindrical drum 5 mounted to an axis 7 driven by a variable speed motor 9. A finely perforated screen 11 is securely mounted coaxially within the centrifuge drum or basket 5.

A special divise 13 is disposed perpendicular to the axis 7, it does not allow spill of massecuite during the time of charge this divise 13, might be a circular plate although other arrangements may be devised to direct the material for separation towards the spinning drum.

In operation, the centrifuge drum 5 is set in motion by the motor 9 communicating with the axis 7. The centrifuge basket rotates at a speed of approximately 1,200 to 1,400 r.p.m. for high grade massecuite or mother liquor. For lower grades, the centrifuge rotates at approximately 1,800 to 2,200 r.p.m.

After the centrifuge has reached speed of charge A mother liquor or massecuite 1 is admitted through an inlet 2 in the top of the centrifuge 3. The massecuite falls against the spinning basket. The device 13 which directs the falling charge radially outward until it reaches the perforated screen 11. The perforations in the screen are small enough to retain the sugar crystals, while the syrup passes through the perforated screen 11 to the centrifuge drum or basket 5. The drum is also perforated to allow the syrup to pass through the drum for collection in fluid jacket 18 and exit at a syrup outlet 19 in the jacket.

After separation, which in first and second grades of massecuite requires approximately two minutes, the sugar crystals accumulated against the screen 11 will have formed a compated mass 12. The centrifuge is then decelerated to approximately 100 to 200 r.p.m., after which a substantial braking force is applied by any conventional braking system, such as a brake shoe 25 engaging a brake disc 23 mounted coaxially with and at the top of drum 5.

This rapid deceleration stops the spinning centrifuge drum 5 and screen 11, but the compacted sugar crystals 12 break free of the screen 11 and continue in their rotation due to their rotational inertia. Through the force of gravity they descend the wall of the centrifuge drum 5, ultimately reaching the base 16 of the drum. The base 16 includes a plurality of exit apertures 17 through which the sugar crystals may pass. After leaving the centrifuge drum 5, the sugar crystals exit the centrifuge through a sugar crystal outlet 21 for collection.

To those skilled in the art it will be apparent that the present invention is capable of taking various useful forms, and it is preferred, therefore, that this disclosure be taken in an illustrative sense, and that the scope of protection afforded be determined by the appended claims.

What is claimed as the invention is:

1. A method for separating sugar crystals from fluid matter containing sugar crystals, said method comprising:

rotating said matter at a speed greater than 1200 r.p.m. to subject it to a centrifugal force;

restraining said crystals, urged by said force, from movement beyond a predetermined point defined by a screen means fixedly mounted to the inside surface of a rotatably mounted drum;

passing undesired portions of said matter away from said crystals and through said screen means simultaneously with restraining step;

applying a braking force to bring the drum to substantial rest in less than approximately one second, said crystals being caused to disengage from said screen means and continue rotation by the resulting inertial force; and collecting said crystals.

2. The method according to claim 1 wherein said braking force is sufficient to reduce the rotational speed from approximately 200 r.p.m. to substantial rest in less than approximately one second.

3. The method according to claim 1 wherein said matter is rotated at a speed between 1200 and 1400 r.p.m.

4. The method according to claim 1 wherein said matter is rotated at a speed between 1800 and 2200 r.p.m.

5. The method according to claim 1 further comprising:

introducing said fluid matter into an interior portion of the rotatable drum after the drum has reached full rotational speed;

deflecting said fluid matter outwardly toward the screen means.

6. The method according to claim 1 wherein the rotatable drum includes a base portion including at least one aperture and said sugar crystals are collected by passing said crystals through the aperture.

7. In a sugar centrifuge of the type having a rotatable surface for retaining sugar crystals, said surface being rotatable at speeds greater than 1200 r.p.m., the improvement comprising:

brake means associated with said surface capable of decelerating said surface from over 1000 r.p.m. to substantial rest in less than approximately one second for causing compacted crystals to disengage from said surface.

* * * * *